US005778848A

United States Patent [19]

Takahashi et al.

[11] Patent Number: 5,778,848

[45] Date of Patent: Jul. 14, 1998

[54] FOUR-CYCLE OUTBOARD MOTOR LUBRICATING SYSTEM

[75] Inventors: Masanori Takahashi; Atsushi Isogawa, both of Hamamatsu, Japan

[73] Assignee: Sanshin Kogyo Kabushiki Kaisha, Hamamatsu, Japan

[21] Appl. No.: 692,873

[22] Filed: Aug. 2, 1996

[30] Foreign Application Priority Data

Aug. 7, 1995 [JP] Japan ..... 7-200981

[51] Int. Cl.[6] ..... F01M 11/02

[52] U.S. Cl. ..... 123/196 W; 123/196 AB

[58] Field of Search ..... 123/196 W, 196 AB

[56] References Cited

U.S. PATENT DOCUMENTS

| | | | |
|---|---|---|---|
| 2,496,434 | 2/1950 | Bosma | 123/196 W |
| 4,709,671 | 12/1987 | Sumigawa | 123/196 W |
| 5,014,775 | 5/1991 | Watanabe | 123/196 AB |
| 5,215,164 | 6/1993 | Shibata | 123/196 W |
| 5,388,555 | 2/1995 | Shiomi et al. | 123/196 W |
| 5,613,470 | 3/1997 | Shiomi et al. | 123/196 W |

*Primary Examiner*—Erick R. Solis

*Attorney, Agent, or Firm*—Knobbe, Martens, Olson & Bear LLP

[57] ABSTRACT

A four-cycle outboard motor having an oil tank that is disposed at least in part in the drive shaft housing of the outboard motor and an oil pump that is driven off of the lower end of the crankshaft. At least a portion of the conduits for transmitting oil from the oil tank to the oil pump and from the oil pump to the engine for its lubrication being formed integrally in a lower face of the cylinder block.

11 Claims, 3 Drawing Sheets

FOUR-CYCLE OUTBOARD MOTOR LUBRICATING SYSTEM

BACKGROUND OF THE INVENTION

This invention relates to an outboard motor and more particularly to an improved lubricating system for a four-cycle outboard motor.

Although two-cycle engines have been conventionally employed as the power plant for outboard motors because of their simplicity and high specific output, certain disadvantages thereof have prompted the resort to four-cycle engines for such purposes. The four-cycle engine has the advantage of providing a recirculating lubricating system and thus offers better assurance against the escape of lubricants to the atmosphere.

However, the very advantage of four-cycle engines gives rise to certain design problems. Specifically, it is necessary with four-cycle outboard motors to provide adequate lubricant storage within the outboard motor for the engine lubricating system. One way in which this problem has been solved is by positioning the oil reservoir for the engine in the upper portion of the drive shaft housing. By utilizing such a location, the power head becomes less encumbered, and access to the outboard motor engine for service is facilitated. However, the drive shaft housing positioning of the oil tank can at times place it remotely from the oil pump. Thus, there is some potential delay between the time when the engine starts running and when the oil pump can draw the lubricant from the oil reservoir and deliver it to the engine for lubrication. This delay is obviously undesirable.

It is, therefore, a principal object of this invention to provide an improved lubricating system for a four-cycle outboard motor.

It is a further object of this invention to provide an improved oil pump drive arrangement for such an outboard motor wherein the oil pump can be positioned in close proximity to the oil tank.

One way in which oil pumps have been driven for four-cycle engines is by driving them off the lower end of the camshaft of the engine. This provides the advantage of positioning the oil pump low and in proximity to the oil tank. However, this location and other locations which have been chosen generally result in an oil pump that is mounted as an auxiliary on the outside of the engine. This results in the formation of a number of the oil passages, either to or from the oil pump externally of the body of the engine. This has obvious disadvantages.

It is, therefore, a still further object of this invention to provide an improved oil pump and circulating system for a four-cycle outboard motor.

It is yet a further object of this invention to provide an improved oil pump drive for an outboard motor wherein the oil conduits for the oil pump can be formed in large part internally of the engine body and thus eliminate the use of external conduits.

SUMMARY OF THE INVENTION

This invention is adapted to be embodied in an outboard motor having a power head comprised of a four-cycle internal combustion engine and surrounding protective cowling. The engine is supported within the power head so that its crankshaft rotates about a vertically extending axis. A drive shaft housing and lower unit depends from the power head and contains a drive shaft that is coupled to the engine crankshaft for driving the drive shaft. A propulsion unit is driven by the drive shaft for propelling an associated watercraft. An oil tank for the engine is disposed beneath the engine and contains oil for lubricating the engine. An oil pump is driven off of the lower end of the crankshaft in the area where the crankshaft is connected to the drive shaft. This oil pump is juxtaposed to a lower face of a cylinder block of the engine in which at least one oil passage is integrally formed for conveying lubricant from the oil tank to the engine for its lubrication and which oil has been pumped by the oil pump.

DETAILED DESCRIPTION OF THE PREFERRED EMBODIMENTS OF THE INVENTION

Figure 1:
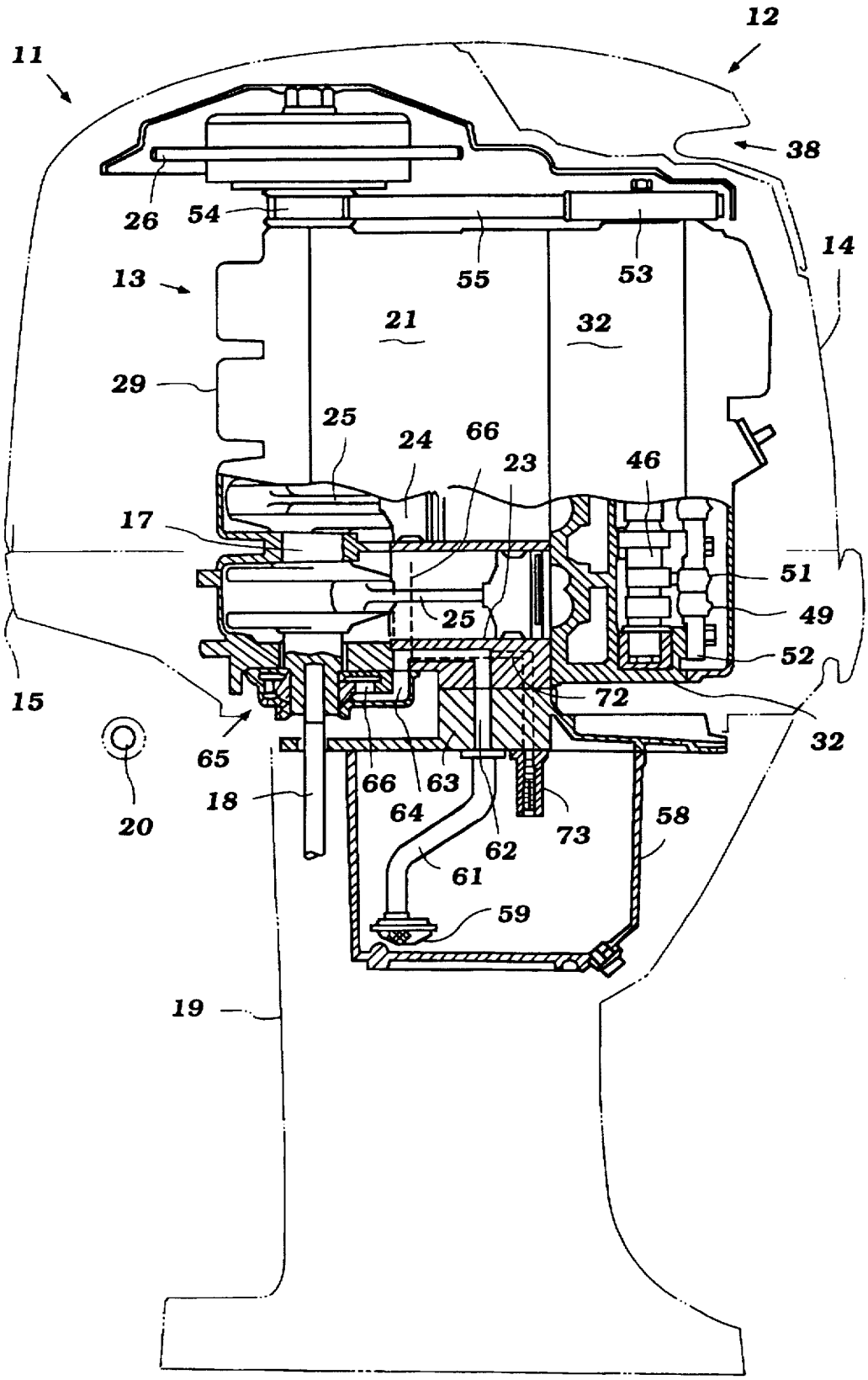
FIG. 1 is a side elevational view of an outboard motor constructed in accordance with an embodiment of the invention and with the lower portion of the outer surface of the engine broken away to show various components of the engine and its lubricating system.

Referring now to the drawings and initially to FIG. 1, an outboard motor constructed in accordance with an embodiment of the invention is indicated generally by the reference numeral 11. The outboard motor 11 is comprised of a powerhead 12 that includes a powering internal combustion engine 13. The engine 13 is surrounded by a protective cowling that is comprised of a main cowling portion 14 which is detachably connected to a tray portion 15. A guide plate 16 is connected to the tray 15 and to which the engine 13 is mounted in any suitable manner.

As is typical with outboard motor practice, the engine 13 is supported within the powerhead 12 so that its output shaft, a crankshaft indicated by the reference numeral 17, rotates about a vertically extending axis. This crankshaft 17 is rotatably coupled to a drive shaft 18 that rotates about a vertically extending axis and extends through the guide plate 16 and depends into and is journaled within a drive shaft housing and lower unit 19. The tray 15 encircles the upper portion of the drive shaft housing and lower unit 19.

The lower end of the drive shaft 18 is coupled within the drive shaft housing and lower unit 19 to a conventional forward/reverse bevel gear transmission (not shown) which, in turn, is coupled to a propulsion device (not shown), such as, for example, a propeller, for driving the propulsion device in selected forward or reverse directions so as to so propel an associated watercraft (not shown). The outboard motor 11 is affixed to the watercraft by means which allows for the rotation of the outboard motor 11 about a generally vertically extending steering axis, as well as the tilting of the outboard motor 11 about a pivot shaft 20 of the associated watercraft.

The engine 13 will now be described in detail with additional reference to FIG. 2. The engine 13 is in the illustrated embodiment of the four-stroke, four-cylinder, inline-type of configuration. To this end, the engine 13 is provided with a cylinder block 21 in which four horizontally extending parallel openings are formed in a vertically spaced relationship with each other and in which are pressed fitted sleeves 22 that define cylinder bores 23 in which pistons 24 reciprocate.

Although the invention is described in conjunction with a four-cylinder, inline engine, it will be readily apparent to those skilled in the art how the invention may be utilized with engines having various cylinder numbers and cylinder configurations.

The pistons 24 are pivotally connected to the small ends of respective connecting rods 25 whose big ends are rotatably journaled about the throws of the crankshaft 17. A flywheel 26 is affixed to the upper end of the crankshaft 17 and assists in the smooth operation of the engine 13 at lower engine speeds, while the lower end of the crankshaft 17 is used for driving a lubricating system in a manner which will be described in detail later.

The crankshaft 17 is rotatably journaled about a vertically disposed axis by any suitable means within a crankcase 28 which is defined by the forwardly facing end of the cylinder block 21 and a crankcase member 29 which is affixed to the front face of the cylinder block 21 by any suitable means.

The engine 13 is water cooled. For this reason, a plurality of water jackets 30 are disposed adjacent to and above the cylinder bores 23 so as to cool the engine 13. As seen in FIG. 2, some of the water jackets 30 are defined by the cooperation of the exterior surface of the cylinder block 21 with a plate portion 31 that is bolted to the exhaust side of the cylinder block 21 and used to cool the exhaust system for the engine 13. It will also be seen that the coolant from these water jackets 30 is also used in the cooling of the lubricant for the engine 13.

A cylinder head is indicated by the reference numeral 32 and affixed to the rearward facing end of the cylinder block 21 in a known manner. The cylinder head 32 has individual recesses 33 that cooperate with the cylinder bores 23 and pistons 24 to define the engine combustion chambers. An intake valve 34 is slidably supported in the cylinder head 32 for each combustion and controls and intake port 35 that cooperates with the inner end of an intake passage 36 formed in the cylinder head 32. The outer end of the intake passage 36 terminates at an induction and charge forming system that includes an airbox 37. The airbox 37 receives a supply of atmospheric air through an opening 38 formed in the upper end of the main cowling 14 and delivers the air through an intake manifold 39 to a carburetor 40. The carburetor 40 mixes the air with a supply of fuel from a fuel tank (not 30 shown) suitably positioned within the hull of the associated watercraft in a ratio that is suitable for combustion. This air fuel charge is then delivered to the combustion chamber 33 through the intake passage 36. The amount of air fuel delivered to the combustion chamber 33 is regulated by a throttle valve (not shown) that is disposed within the carburetor 40.

An exhaust valve 41 is slidably supported in the cylinder head 32 for each combustion chamber and controls the flow of the exhaust gases from the combustion chambers 33 through an exhaust port 42 and into an exhaust passage 43. The exhaust passage 43 cooperates with an exhaust discharge passage 44 which is integrally formed within the cylinder block 21 and opens to an exhaust manifold 45 that is also integrally formed within the cylinder block 21. From the exhaust manifold 45 the exhaust gases are discharged and silenced through an exhaust system (not shown) from the outboard motor to the atmosphere through the body of water in which the associated watercraft is operating in a manner that is well known in the art.

A single overhead camshaft is indicated by the reference numeral 46 and rotatably journaled within the cylinder head 32 between the intake and exhaust valves 34 and 41.

The camshaft 46 is provided with intake and exhaust cam lobes 47 and 48, respectively, that operate on intake and exhaust rocker arms 49 and 51, respectively, which are rotatably journaled about a rocker arm shaft 52. The rocker arm shaft 52 is mounted within the cylinder head 32 above of and extending parallel to the camshaft 46. The outer ends of the intake and exhaust rocker arms 49 and 51 operate on the tips of the intake and exhaust valves 34 and 41.

A camshaft pulley 53 is affixed to the upper end of the camshaft 46 and is driven by a crankshaft pulley 54 that is affixed to the upper end of the crankshaft 17 beneath the flywheel 26 through a drive belt 55. As is well known in the art, the camshaft 46 is driven by the crankshaft 17 at one-half crankshaft speed which is accomplished by a 2 to 1 reduction of the camshaft pulley 53 relative to the crankshaft pulley 54. Thus, the intake and exhaust valves are opened at the appropriate times by their associated cam lobes 47 and 48 by the crank-driven camshaft 46 through the rocker arms 49 and 51. Additionally, intake and exhaust valve return springs 56 and 57 are associated with the valves 34 and 41 respectively and serve to close the valves 34 and 41.

The lubricating system for the engine 13 will now be discussed in detail. The lubricating system supplies oil from a reservoir to the engine in order to maintain the proper near frictionless operation of the engine's moving parts, such as the crankshaft, camshaft and pistons. This reservoir or oil tank is typically disposed along the lower surface of the engine so as to facilitate the return of the oil to the reservoir for subsequent recirculation after cooling and filtering.

A problem exists with this configuration for engines whose crankshafts are disposed vertically as above, however, in that such an alignment generally tends to position the oil pump at some distance from the oil tank and, thus, necessitates the use of a lengthy and external connecting conduit means between the oil pump and oil tank and the oil pump and the engine. This tends to delay the supply of oil to the engine when the engine is initially started. This invention eliminates these problems by driving the oil pump off the lower end of the crankshaft and using connecting conduit means that are formed integrally within the engine cylinder block.

Figure 2:
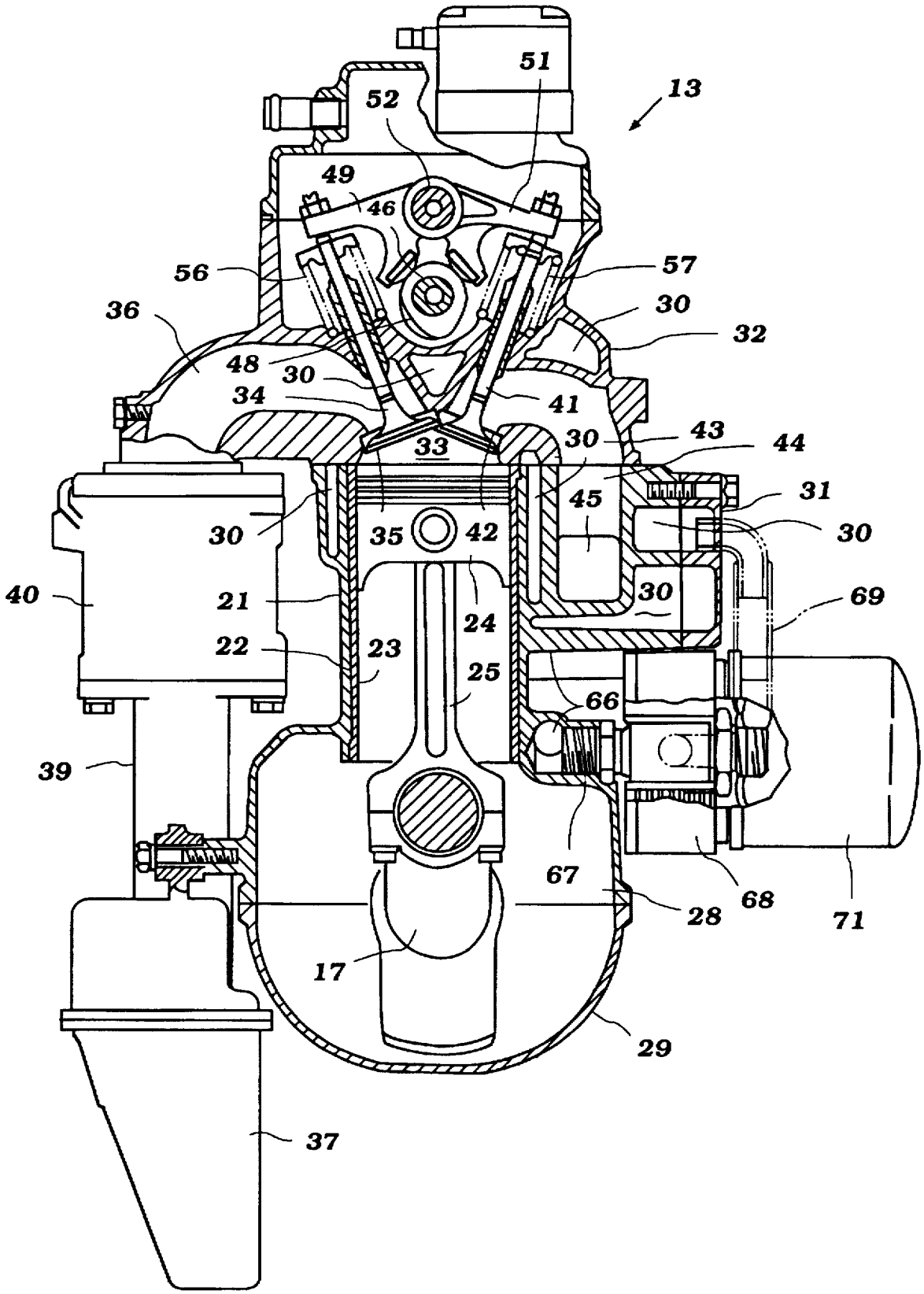
FIG. 2 is a horizontal cross-sectional view of the engine.

With continued reference to FIGS. 1 and 2, an oil reservoir or tank is indicated by the reference numeral 58 and contained within the drive shaft housing and lower unit 19. The upper end of the oil tank 58 is affixed by any suitable means to the lower surface of the guide plate 16 to which the engine 13 is mounted. A strainer 59 is positioned within the lower end of the oil tank 58 and delivers oil to the lower end of an oil conduit 61. The upper end of the oil conduit 61 opens to an oil passage 62 that is integrally formed in and extends through the guide plate 16. The oil passage 62 in turn connects to an oil supply passage 63 that is integrally formed within the lower face of the cylinder block 21 and supplies oil through an oil inlet 64 to a position displacement, gear type oil pump 65 that is driven by the lower end of the crankshaft 17 in close proximity to the oil tank 58.

The oil pump 65 pumps the oil throughout the engine 13 through a main gallery 66 that is integrally formed within the lower face of the cylinder block 21 and includes a threaded opening 67 that is surrounded by an oil cooler that is indicated by the reference numeral 68 and located on an external side of the engine 13 in proximity to the crankcase 28. Oil from the delivery passage 66 is cooled by the oil cooler 68 which is supplied with coolant from one of the waterjackets 30 defined by the plate portion 31 through an external coolant pipe 69.

From the oil cooler 68 the oil enters an oil filter 71 which threadingly engages the outer surface of the oil cooler 68 where it is filtered before returning to the delivery passage 66 and circulating throughout the engine 13.

The oil delivery passage 66 includes a pressure relief passage 72 which opens to and receives a supply of oil from the delivery passage 66. This return oil passage 72 is integrally formed within the lower face of the cylinder block 21 and also extends downwardly through the guide plate 16 and terminates at a pressure relief valve 73 that is located in the oil tank 58 and affixed to the lower surface of the guide plate 16 by any suitable means. The pressure relief valve 73 controls the pressure of the oil circulated throughout the engine 13 by returning excess oil to the oil tank 58 when the oil pressure in the main gallery 66 and return passage 72 exceeds the desired value.

With the above lubricating system configuration, delay in oil delivery at engine startup is minimized since the oil pump 65 which is driven by the crankshaft 17 is mounted in close proximity to the oil tank 58 and therefore only a minimum of connecting conduit means are needed. Also, since the conduit means for the lubricating system are integrally formed within the lower face of the cylinder block 21, the packaging problems normally associated with external conduit means are eliminated.

Figure 3:
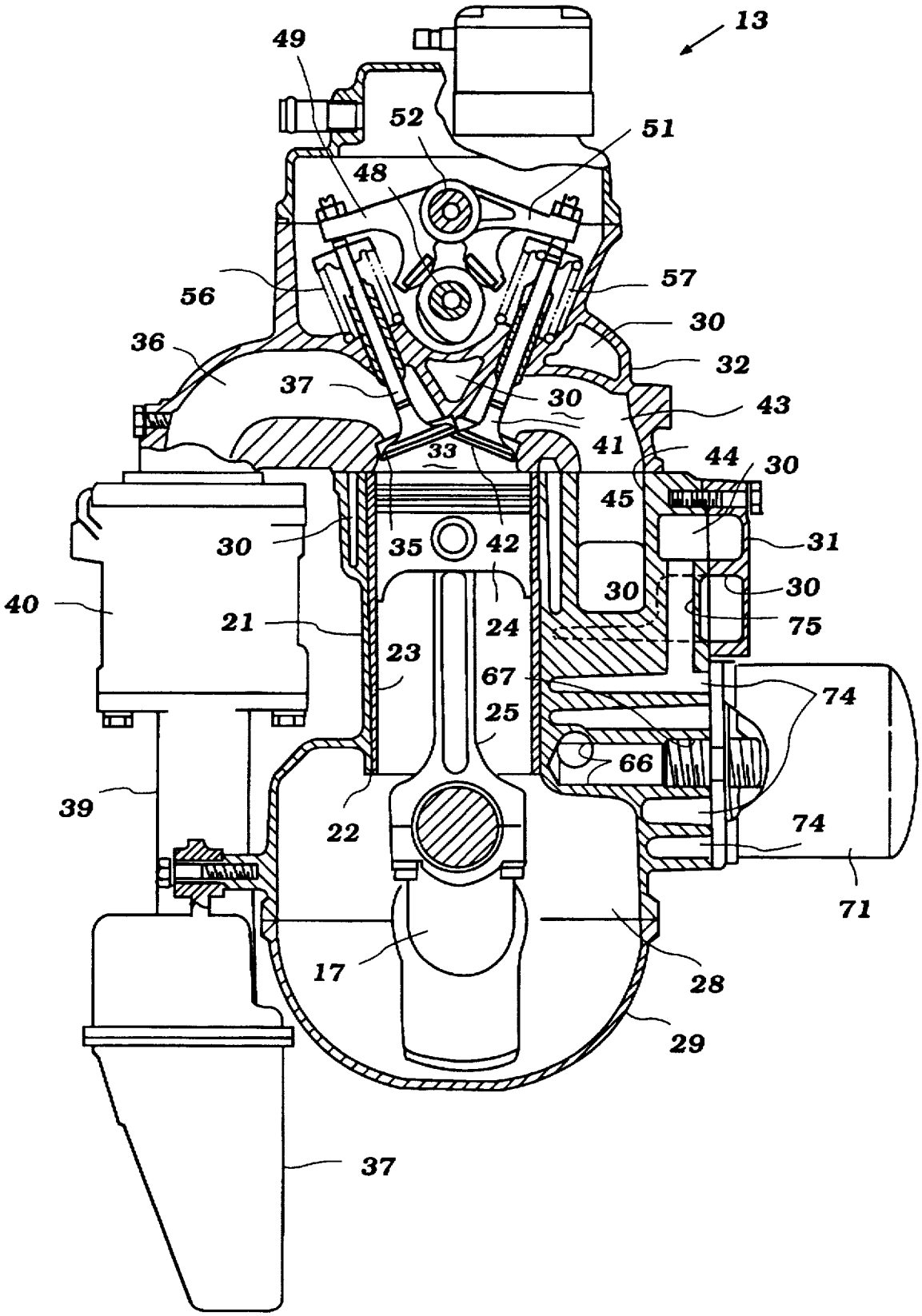
FIG. 3 is a cross-sectional view, in part similar to FIG. 2, and shows another embodiment of the invention.

FIG. 3 illustrates a further embodiment of the invention in which the separate oil cooler of the previous embodiment has been eliminated. Instead, a plurality of additional water jackets 74 are disposed about the oil delivery passage 66 and receive a supply of coolant from a coolant supply conduit 75 that is integrally formed within the cylinder block 21 and opens to the water jacket 30 defined by the plate portion 31. The oil filter 71 is mounted to the side of the engine 13 and threadingly engages the opening 67. With this configuration, the oil in the delivery passage 66 is cooled by the jacket 74 before entering the oil filter 71 while the overall width of the engine 13 is reduced since the oil filter 71 is mounted directly to the side of the engine 13.

Thus, from the foregoing description it should be readily apparent that the described construction provides a very compact assembly, one in which the oil pump is positioned in close proximity to the oil tank and which the oil pump is driven by the engine crankshaft.

In addition, the oil passages for conveying oil from the oil tank to the oil pump and from the oil pump to the engine for its lubrication are formed at least in substantial part in the lower face of the cylinder block so as to minimize the number of external conduits. Of course, the foregoing description is that of a preferred embodiment of the invention. Those skilled in the art will readily understand how the invention may be applied to other constructions, as described in the preferred embodiments without departing from the spirit and scope of the invention, as defined by the appended claims.

What is claimed is:

1. An outboard motor comprised of a power head containing a four-cycle internal combustion engine, said engine including a cylinder block defining at least one horizontally extending cylinder bore, a crankcase member affixed to said cylinder block at one end of said cylinder bore and forming a crankcase chamber, a crankshaft rotatably journalled in said crankcase chamber, a protective cowling encircling said engine, said engine being supported in said power head so that said crankshaft rotates about a vertically disposed axis, a drive shaft housing and lower unit depending from said power head and journaling a drive shaft for rotation about a vertically extending axis, means for coupling said drive shaft to said engine crankshaft for driving said drive shaft, a propulsion device driven by said drive shaft for propelling an associated watercraft, an oil tank for containing lubricant for said engine contained at least in part in said drive shaft housing and lower unit, an oil pump driven off the lower end of said crankshaft for pumping oil, and conduit means for interconnecting said oil tank with said oil pump and said oil pump with said engine for lubricating said engine including at least one conduit portion formed integrally in a lower face of said cylinder block.

2. An outboard motor as set forth in claim 1, wherein the lower face of the cylinder block forms a supply passage for extending from the oil tank to the oil pump and a delivery passage extending from the oil pump to the engine for lubricating the engine.

3. An outboard motor as set forth in claim 2, further include a pressure return valve in said delivery conduit for limiting the pressure of lubricant pumped by said oil pump to said engine lubricating system by returning excess oil directly to said oil tank.

4. An outboard motor as set forth in claim 1, further including a flywheel fixed to the upper end of the crankshaft.

5. An outboard motor as set forth in claim 1, further including an oil filter mounted on the cylinder block and to which oil is delivered by said oil conduit from the oil pump.

6. An outboard motor as set forth in claim 5, wherein the engine is formed with a water cooling jacket and further including an oil cooler interposed in the flow path of oil from the oil pump to the oil filter and cooled by the engine coolant for cooling the oil delivered to the engine.

7. An outboard motor as set forth in claim 6, wherein the oil cooler is interposed between the cylinder block and the oil filter.

8. An outboard motor as set forth in claim 6, wherein the oil cooler is formed integrally in the cylinder block.

9. An outboard motor as set forth in claim 6, wherein the lower face of the cylinder block forms a supply passage extending from the oil tank to the oil pump and a delivery passage extending from the oil pump to the oil filter.

10. An outboard motor as set forth in claim 9, further include a pressure return valve in said delivery conduit for limiting the pressure of lubricant pumped by said oil pump to said engine lubricating system by returning excess oil directly to said oil tank.

11. An outboard motor as set forth in claim 10, further including a flywheel fixed to the upper end of the crankshaft.

* * * * *